US008851467B2

(12) United States Patent
Shiota

(10) Patent No.: US 8,851,467 B2
(45) Date of Patent: Oct. 7, 2014

(54) RECORDING MATERIAL FEED CASSETTE AND RECORDING APPARATUS

(75) Inventor: Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 13/422,111

(22) Filed: Mar. 16, 2012

(65) Prior Publication Data

US 2012/0235345 A1 Sep. 20, 2012

(30) Foreign Application Priority Data

Mar. 18, 2011 (JP) ..... 2011-060829

(51) Int. Cl.
*B65H 3/44* (2006.01)
*B65H 1/26* (2006.01)

(52) U.S. Cl.
CPC ..... *B65H 1/266* (2013.01); *B65H 2405/121* (2013.01); *B65H 2405/1116* (2013.01); *B65H 2405/332* (2013.01)
USPC ..... 271/9.11; 271/9.01; 271/145

(58) Field of Classification Search
USPC ..... 271/171, 145, 9.11
See application file for complete search history.

(56) References Cited

U.S. PATENT DOCUMENTS

| | | | | |
|---|---|---|---|---|
| 6,869,071 | B2 * | 3/2005 | Amamoto et al. | 271/145 |
| 7,527,259 | B2 * | 5/2009 | Meetze et al. | 271/171 |
| 2010/0001460 | A1 * | 1/2010 | Kawarago | 271/162 |
| 2010/0124449 | A1 | 5/2010 | Asada et al. | |

FOREIGN PATENT DOCUMENTS

| | | |
|---|---|---|
| JP | 2010-173832 | 8/2010 |

* cited by examiner

*Primary Examiner* — Michael McCullough
*Assistant Examiner* — Howard Sanders
(74) *Attorney, Agent, or Firm* — Workman Nydegger

(57) ABSTRACT

A recording material feed cassette includes first and second cassette portions. The second cassette portion is assembled so as to be capable of extending/retracting relative to the first cassette portion and, along with the first cassette portion, contains a recording material. A locking mechanism fixes the position of the second cassette portion relative to the first cassette portion. The locking mechanism has a lock portion capable of moving in a first direction that is orthogonal to the extension/retraction direction so as to take on a locked position and an unlocked position, an operation portion that is capable of moving in a second direction that follows the extension/retraction direction, and a connection portion that connects the lock portion and the operation portion and that is capable of deforming as a result of the movement of the lock portion in the first direction.

8 Claims, 15 Drawing Sheets

RECORDING MATERIAL FEED CASSETTE AND RECORDING APPARATUS

BACKGROUND

1. Technical Field

The present invention relates to recording material feed cassettes provided with extendable/retractable cassette portions that can change the size of a containment space in accordance with the size of a recording material used, and to recording apparatuses provided with such recording material feed cassettes.

2. Related Art

There are many types of recording apparatuses, such as ink jet printers, laser printers, copiers, facsimile devices, that include removable recording material feed cassettes (also called "feed cassettes" hereinafter). Such a feed cassette holds multiple sheets of a recording material (also called "paper" hereinafter) in a stacked state and is used by being fitted into the main portion of the recording apparatus (also called a "main printer unit" hereinafter).

As disclosed in JP-A-2010-173832, such a feed cassette is divided into a first cassette portion and a second cassette portion, and the first cassette portion and second cassette portion are assembled so as to be capable of extending/retracting relative to each other, so that the size of a containment space can be changed in accordance with the size of the paper that is used. A locking mechanism that locks the first cassette portion and the second cassette portion in an unextendable/unretractable state is provided at a predetermined extension/retraction position.

The stated locking mechanism includes an operation portion and a lock rod. The direction in which the lock rod is moved in order to release the lock is the direction orthogonal to the extension/retraction direction of the feed cassette. The lock rod and the operation portion are integrated in an L shape, and when a user grips the operation portion, the force thereof is converted into a pivoting motion of the lock rod via a rotation shaft, which brings a lock retaining portion on the leading end of the lock rod away from the locked position.

The stated locking mechanism is configured so that when the operation portion is gripped, the lock rod that is integrated therewith is pivoted, thus moving the stated lock retaining portion in the direction that releases the lock.

However, there is a problem in that if the lock rod has a low rigidity, the lock rod itself will elastically deform, causing the pivoting of the lock rod to become unstable and reducing the reliability of the lock release.

In addition, the operation portion is moved rotationally around a rotation shaft rather than linearly, and thus the movement of the operation unit does not match the extension/retraction direction of the feed cassette. Accordingly, there is another problem in that there is a poor flow in the series of operations from the lock release operation to the extension/retraction operation of the feed cassette.

SUMMARY

It is an advantage of some aspects of the invention to, in an extendable/retractable recording material feed cassette, increase the reliability of a lock release in a locking mechanism, and enable a series of operations from a lock release operation to an extension/retraction operation of the feed cassette to be carried out smoothly.

A recording material feed cassette according to a first aspect of the invention includes: a first cassette portion; a second cassette portion that is assembled with the first cassette portion so as to be capable of extending/retracting relative to the first cassette portion and that, along with the first cassette portion, contains a recording material; and a locking mechanism that fixes the position of the second cassette portion relative to the first cassette portion. Here, the locking mechanism has: a lock portion capable of moving in a first direction that is orthogonal to the extension/retraction direction so as to take on a locked position and an unlocked position; an operation portion that is provided in the second cassette portion and that is capable of moving in a second direction that follows the extension/retraction direction; and a connection portion that connects the lock portion and the operation portion and that is capable of deforming as a result of the movement of the lock portion in the first direction.

According to this aspect, the operational direction of the operation portion in the locking mechanism is the same as the extension/retraction direction of the feed cassette (that is, the second direction). Accordingly, movement resulting from the operation of the operation portion is linear, rather than the rotational movement employed in the past. The linear motion of the operation portion in the extension/retraction direction is converted, by the deformation of the deformable connection portion, into movement of the lock portion in the unlocking direction (the first direction, which is orthogonal to the extension/retraction direction). It is thus possible to, in the extendable/retractable recording material feed cassette, increase the reliability of the lock release in the locking mechanism, and enable a series of operations from a lock release operation to an extension/retraction operation of the feed cassette to be carried out smoothly.

A second aspect of the recording material feed cassette according to the invention is the aforementioned first aspect, in which the connection portion has an elastic deformation portion that, by elastically deforming, converts a force in the second direction inputted through the operation portion into a force in the first direction and causes the lock portion to move.

According to this aspect, a force inputted into the operation portion in the second direction (the extension/retraction direction) is transmitted to the elastic deformation portion and, due to the elastic deformation of the elastic deformation portion, generates a movement force that causes the lock portion to move in the first direction (an unlocking direction, which is orthogonal to the extension/retraction direction). Accordingly, the connection portion can simply be configured of the elastic deformation portion, which is a single member, and thus in addition to the effects of the aforementioned first aspect, the cost of the recording material feed cassette that includes the locking mechanism can be reduced.

A third aspect of the recording material feed cassette according to the invention is the aforementioned second aspect, in which the lock portion, the operation portion, and the connection portion are formed as an integrated unit; and the elastic deformation portion is formed as a shape that is more susceptible to elastic deformation than the portions that configure the operation portion and the lock portion.

Here, "a shape that is more susceptible to elastic deformation" refers to a three-dimensional shape that elastically deforms with ease.

According to this aspect, the lock portion, the operation portion, and the connection portion that configure the locking mechanism are formed as an integrated unit and can all be formed of a single member; this makes it possible to simplify the structure, make production easier, and furthermore make the locking mechanism more compact.

In addition, the elastic deformation portion is obtained by forming a shape that is more susceptible to elastic deformation than the portions of which the operation portion and the lock portion are configured, and thus an elastic deformation portion that achieves the desired elastic deformation effects can be manufactured even using the same material as the lock portion and the operation portion, for which rigidity is required.

In addition, because the rigidity of the operation portion and the lock portion can be increased, it is easy to increase the reliability of the operations of the lock portion and the operation portion.

A fourth aspect of the recording material feed cassette according to the invention is the aforementioned first aspect, in which the operation portion is configured so that the movement of the operation portion in the second direction is guided by a guide portion.

According to this aspect, the linear movement of the operation portion is stabilized by the guide portion, and thus it is possible to effectively carry out the transmission of movement resulting from the deformation of the elastic deformation portion.

A fifth aspect of the recording material feed cassette according to the invention is the aforementioned first aspect, in which the lock portion has a pivoting arm that pivots central to a pivot support point, and the free end of the pivoting arm has a lock retaining portion that engages with the first cassette portion.

According to this aspect, the trajectory of the movement of the lock portion is regulated by the pivoting arm that pivots central to the pivot support point. Accordingly, the precision of movement of the lock portion can be improved, and can therefore be switched between the locked state and the unlocked state in a stable manner.

A sixth aspect of the recording material feed cassette according to the invention is the aforementioned first aspect, in which the lock portion is biased in a locking direction by a biasing member.

It is possible for the user to operate the operation portion only when unlocking the lock portion and changing the extension/retraction position of the second cassette portion. According to this aspect, the operation for locking the lock portion is executed as a result of the biasing force of the biasing member, and thus the operability of the locking mechanism is improved.

A seventh aspect of the recording material feed cassette according to the invention is the aforementioned first aspect, in which the connection portion has: a filament member whose one end is connected to the lock portion and whose other end is connected to the operation portion; and a curved surface portion that changes the direction in which the filament member extends from the operation portion from the second direction to the first direction.

Here, "filament member" as used in this specification refers to a long material that is not self-standing, including a line-shaped material and a band-shaped material; because the filament member itself is not self-standing, it does not achieve functionality for transmitting movement in a flaccid state, but does achieve functionality for transmitting movement in a pulled-out direction by being pulled tautly.

Accordingly, a member formed by twisting natural fibers or synthetic fibers into a filament shape, a band-shaped member produced by weaving or braiding such members, a synthetic resin or metal that has been processed so as to be narrow or thin, and so on are included in the materials of which the stated "filament member" can be configured.

According to this aspect, the filament member is combined with the curved surface portion that changes the extension direction of the filament member from the operation portion from the second direction to the first direction; this makes it possible to achieve functionality for transmitting movement force between two different directions.

Furthermore, it is easy for the filament member to freely change shape, and it is thus possible to transmit movement force between two different directions in three dimensions, rather than only in a single plane.

An eighth aspect of the recording material feed cassette according to the invention is the aforementioned first aspect, in which the connection portion is configured of a long member that can easily bend and deform; and a guiding portion that guides the long member from the second direction to the first direction is provided, and the long member is guided by the guiding portion.

Here, the "long member that can easily bend and deform" as used in this specification refers to a long member that extends and retracts in the lengthwise direction very little, but receives a load for bending in the bending direction and bends as a result, and can therefore transmit movement force between different two directions. Accordingly, a coil spring that has been wound without gaps, a rod-shaped material capable of bending and deforming, and so on are included as the "long member that can easily bend and deform", and a variety of materials, such as synthetic resin, metal, or the like, can be employed as the material thereof.

According to this aspect, the configuration is such that the long member that can easily bend and deform is guided by the guiding portion so that the lengthwise direction of the long member is guided from the second direction to the first direction, and can therefore achieve functionality for transmitting movement force between two different directions.

In addition, the "long member that can easily bend and deform" can also achieve the functionality for transmitting movement force when used in a pushed-in direction, unlike the aforementioned filament member, which can only be used in the pulled-out direction.

A ninth aspect of the invention is a recording apparatus into which a removable recording material feed cassette that contains a recording material in a stacked state can be fitted, in which the recording material feed cassette is the recording material feed cassette according to the aforementioned first aspect.

According to this aspect, a recording apparatus can also achieve the same effect as that of the aforementioned first aspect that is applied to the recording material feed cassette.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
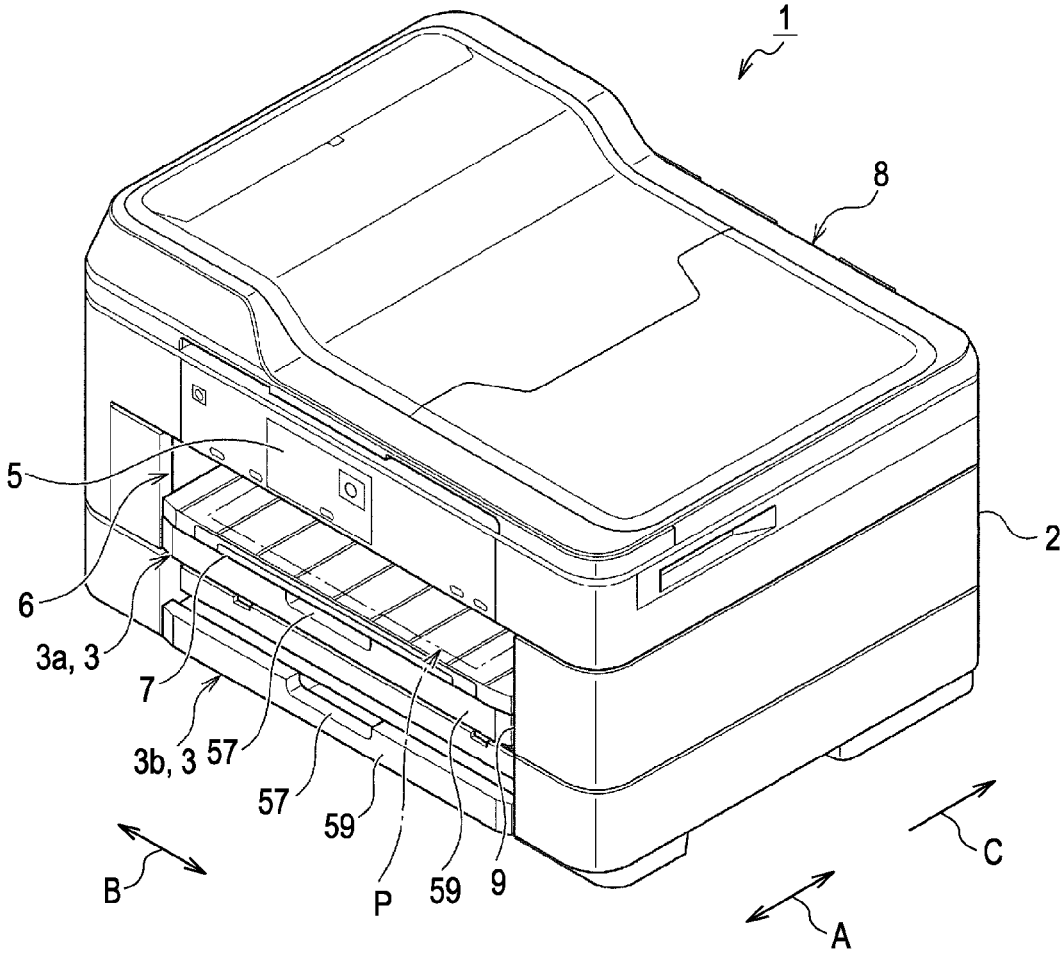
FIG. 1 is a perspective view illustrating a recording apparatus provided with a recording material feed cassette according to a first embodiment of the invention, in a state in which an upper-stage cassette and a lower-stage cassette are both retracted.
Figure 2:
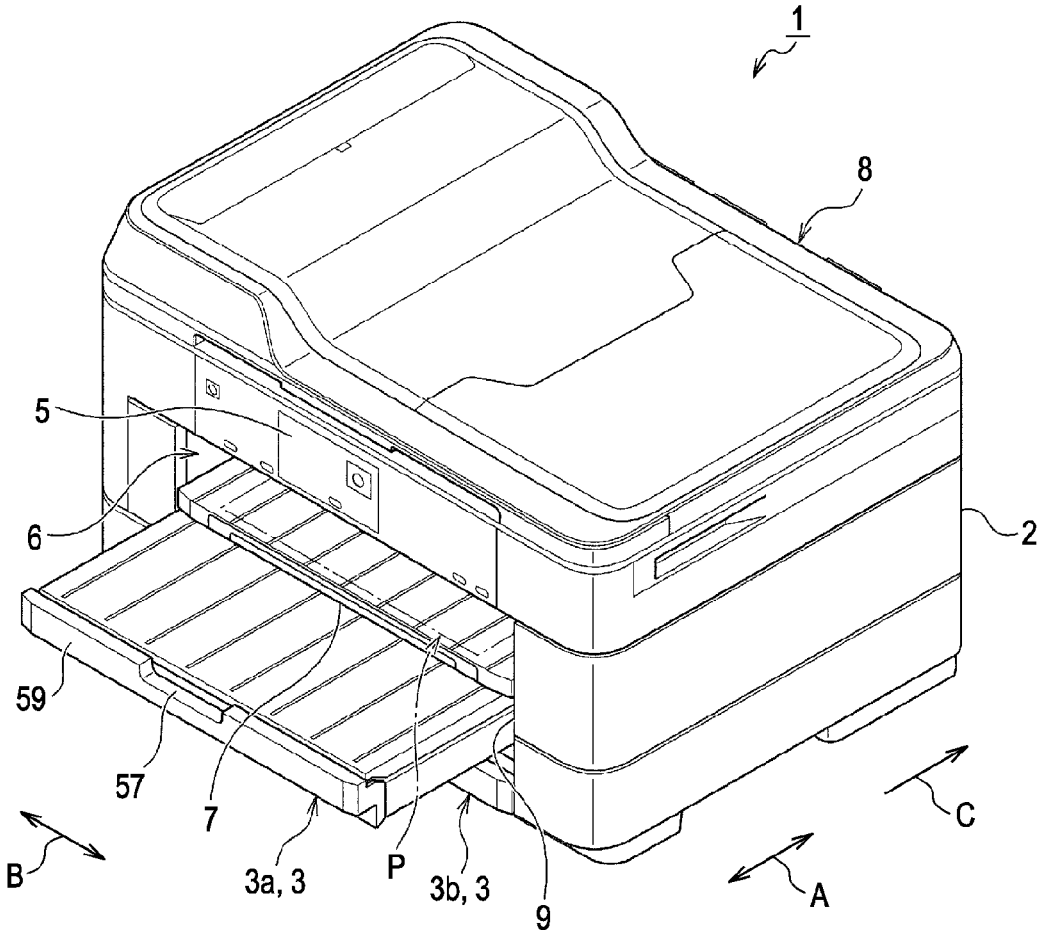
FIG. 2 is a perspective view illustrating a state in which the upper-stage cassette is extended and the lower-stage cassette is retracted, in the recording apparatus provided with the recording material feed cassette according to the first embodiment of the invention.

Hereinafter, the configuration of a recording material feed cassette 3, the configuration of a recording apparatus 1 serving as an example of a device provided with the recording material feed cassette 3, and operations of the recording material feed cassette 3 central to a locking mechanism 47 according to the invention will be described in detail, using a first embodiment illustrated in FIGS. 1 through 13, a second embodiment illustrated in FIG. 14, and a third embodiment illustrated in FIG. 15 as examples.

First, the basic configuration of the recording apparatus 1 according to the invention, in which the recording material feed cassette 3 according to the invention is fitted, will be described based on FIGS. 1 through 5.

The recording apparatus 1 illustrated in FIGS. 1 through 5 is an ink jet printer 1 (the same reference numeral as for the "recording apparatus" will be used) capable of handling paper P up to, for example, super A3 size, and removable feed cassettes 3 according to the invention, which will be described later, are fitted as two stages, or upper and lower, into a lower portion of a main printer unit 2 (the same reference numeral as for a "main recording apparatus unit" will be used) of the ink jet printer 1.

Note that when distinguishing between the upper and lower stages of the feed cassette 3, the cassette disposed in the upper stage will be referred to as an upper-stage cassette 3*a*, and the cassette disposed in the lower stage will be referred to as a lower-stage cassette 3*b*.

These feed cassettes 3 are fitted into a cassette opening 9 formed in a lower area of the front surface of the main printer unit 2, and are configured so as to be capable of being removed from the cassette opening 9.

Meanwhile, a settings/display unit 5 that includes operation buttons and a monitor used when executing various types of operations is provided in, for example, the center of an upper area of the front surface of the main printer unit 2; a discharge opening 6 from which paper P that has been recorded onto is discharged and a discharge stacker 7 that supports the discharged paper P are provided below the settings/display unit 5.

Furthermore, a scanner 8 that reads an image recorded on a document such as paper, a photograph, or the like as electronic data is provided in an upper area of the main printer unit 2.

Figure 5:
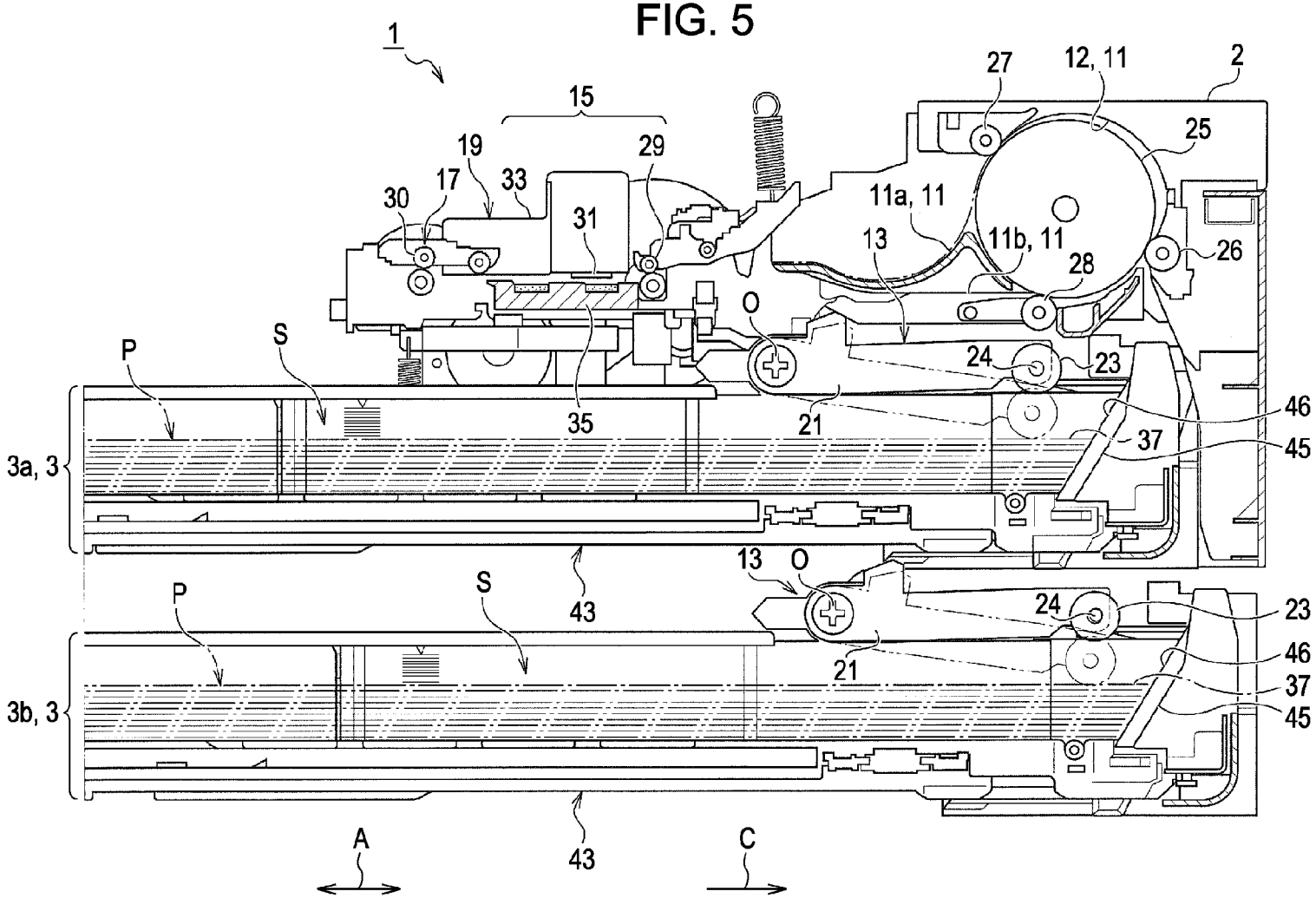
FIG. 5 is a cross-sectional view, taken from the side, illustrating the internal structure of the recording apparatus provided with the recording material feed cassette according to the first embodiment of the invention.

As shown in FIG. 5, the following elements are disposed within the main printer unit 2: feed units 13 that lead the paper P contained in the feed cassettes 3 to a transport path 11; a transport unit 17 that conveys the paper P led to the transport path 11 into a recording execution region 15 and discharges the paper P on which recording has been executed to the aforementioned discharge stacker 7; and a recording execution unit 19 that executes recording on a recording surface of the paper P that has been conveyed to the recording execution region 15.

Of these, each feed unit 13 is configured, as an example, to include: a pivoting arm 21 that pivots central to a pivot support point O; a pickup roller 23 disposed on the leading end of the pivoting arm 21; a driving motor (not shown) that rotationally drives the pickup roller 23; a gear drive train (not shown) that transmits the rotation of an output shaft of the driving motor to a drive shaft 24 of the pickup roller 23; and a pivot driving unit (not shown) that causes the pivoting arm 21 to pivot in the clockwise direction shown in FIG. 5 and causes the pickup roller 23 to come into contact with the uppermost sheet of paper P contained in the corresponding feed cassette 3.

The transport unit 17 is configured, as an example, to include: an inverting roller 25 serving as a large-diameter driving roller disposed in a U-shaped inverting portion 12 of the transport path 11; a retard roller 26 that imparts friction resistance of a predetermined magnitude by pressing upon the inverting roller 25 in order to separate overlapping paper P that has been fed; two guide rollers 27 and 28, disposed respectively in a forward path 11*a* and a return path 11*b* of the transport path 11, that undergo slave rotation by pressing upon the inverting roller 25; transport rollers 29 configured of a pair of nip rollers provided upstream from the recording execution region 15; discharge rollers 30 configured of a pair of nip rollers provided downstream from the recording execution region 15; a driving motor (not shown) that rotationally drives the driving rollers of these respective rollers; and a gear drive train (not shown) that transmits the rotation of an output shaft of the driving motor to the respective driving rollers.

Meanwhile, the recording execution unit 19 is basically configured so as to include: a recording head 31 that executes a desired recording process by ejecting various colors of ink; a carriage 33, in which the recording head 31 is mounted, that moves back and forth in a width direction B that is orthogonal to a transport direction of the paper P; and a support member 35 that ensures a predetermined gap between the recording head 31 and the paper P on which recording is executed by supporting a supported surface of the paper P fed to the recording execution region 15.

First Embodiment

See FIGS. 1-13

The recording material feed cassette 3 according to the invention that is fitted in the ink jet printer 1 configured as described above includes: an extendable/retractable cassette portion 43, the size of whose containment space S can be changed in accordance with the size of the paper P that is used; and the locking mechanism 47 that locks the extension/retraction position of the cassette portion 43.

The cassette portion 43 has a basic configuration that includes: a first cassette portion 49 that is fitted, in an anchored state, to the cassette opening 9 of the main printer unit 2, thus serving as a fitted section of the cassette portion 43; and a second cassette portion 51 that is engaged with and connected to part of the first cassette portion 49, and is provided so as to be capable of retracting and extending relative to the first cassette portion 49 in an extension/retraction direction A.

Meanwhile, the locking mechanism 47 has a basic configuration that includes: a lock portion 97, disposed in an engagement connection section 61 between the first cassette portion 49 and the second cassette portion 51, that assumes a locked position and an unlocked position by moving in the width direction B, which serves as a first direction that is orthogonal to the extension/retraction direction A of the second cassette portion 51; an operation portion 95, disposed on the front side of the second cassette portion 51, that moves linearly in a second direction that follows the extension/retraction direction A of the second cassette portion 51; and a connection portion 69 that connects the lock portion 97 and the operation portion 95.

The connection portion 69 is configured so as to be capable of deforming, in order to convert movement of the operation portion 95 in the second direction A into movement of the lock portion 97 in the first direction B.

The feed cassette 3A according to this embodiment is configured so as to include an elastic deformation portion 73 so that, through elastic deformation, the connection portion 69 converts a force F in the second direction A inputted through the operation portion 95 into a force G in the first direction B and causes the lock portion 97 to move.

Meanwhile, the lock portion 97, the operation portion 95, and the connection portion 69 (elastic deformation portion 73) of which the locking mechanism 47 is configured are configured as components that are formed integrally with each other. The elastic deformation portion 73, meanwhile, is formed as a shape that is more susceptible to elastic deformation than the portions that configure the operation portion 95 and the lock portion 97, and thus has a less-rigid structure.

Furthermore, in the feed cassette 3A according to this embodiment, the lock portion 97 is configured having a lock retaining portion 63 on the free end of a pivoting arm 75 that pivots central to a pivot support point Q provided in the vicinity of the lock portion 97. The lock portion 97 is continually biased in a locking direction D by a compressed coil spring 77, which is an example of a biasing member.

The locking mechanism 47 is provided on the second cassette portion 51 side so as to be capable of moving in the extension/retraction direction A along with the second cassette portion 51, and an engagement structure portion 80, which includes a plurality of engagement recesses 79*a*, 79*b*, and 79*c* that engage with the lock retaining portion 63, is provided in an anchored state on the rear surface of the first cassette portion 49.

Although the basic shapes of the engagement recesses 79*a*, 79*b*, and 79*c* differ in FIGS. 9 through 11 and FIGS. 12 through 13, it should be noted that these are merely variations, and both sets have functionally the same purpose.

First, the constituent elements of the cassette portion 43 will be described.

The first cassette portion 49 is a shallow rectangular tray-shaped member that is closed on part of its leading side surface in a feed direction C, left and right side end surfaces, and its bottom surface, and is open on its top surface. The second cassette portion 51 is, similarly, a shallow rectangular tray-shaped member that is closed on its front surface, left and right side end surfaces, and its bottom surface, and is open on its leading side surface in the feed direction C and its top surface.

Figure 3:
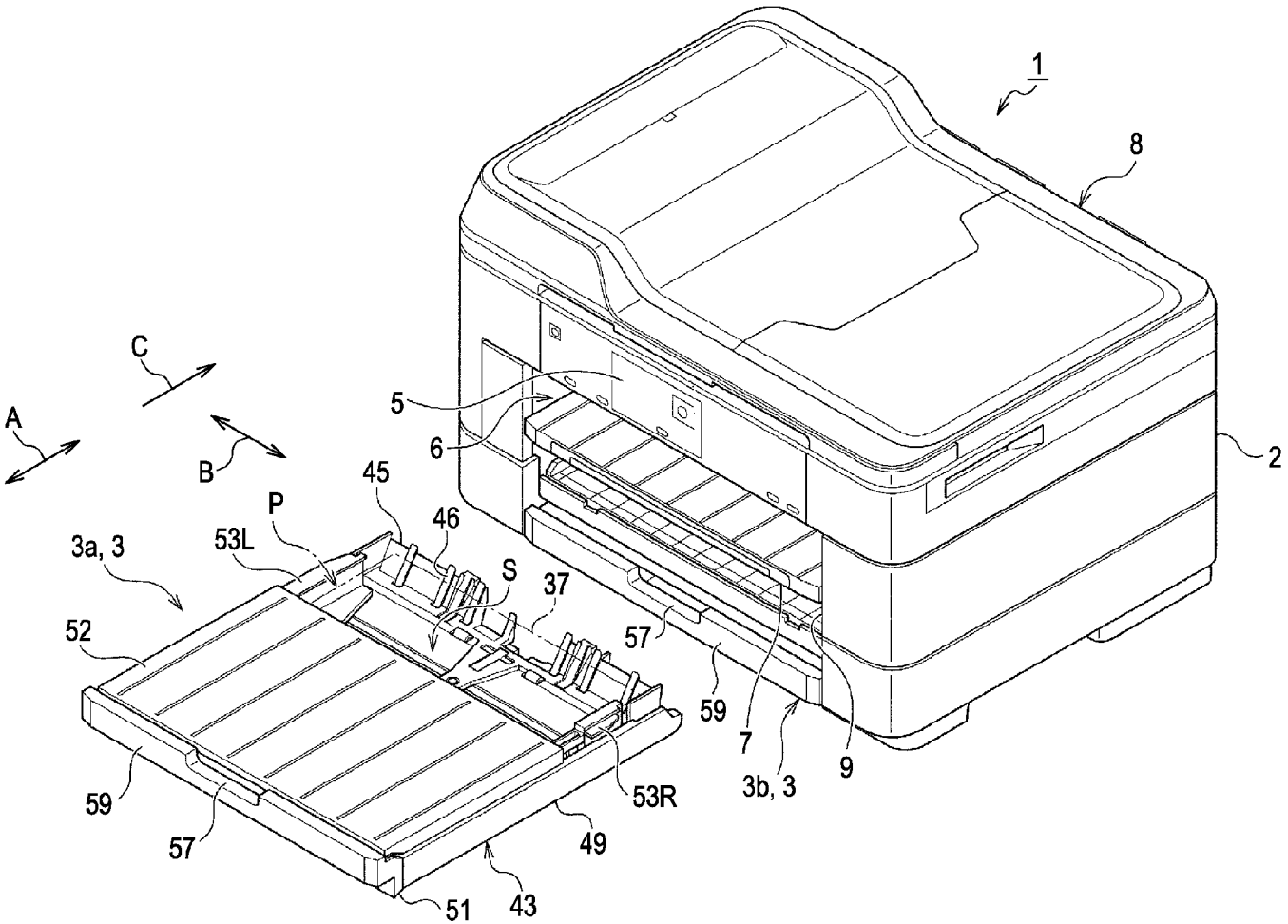
FIG. 3 is an exploded perspective view illustrating a state in which the upper-stage cassette has been removed and the lower-stage cassette is retracted, in the recording apparatus provided with the recording material feed cassette according to the first embodiment of the invention.
Figure 4:
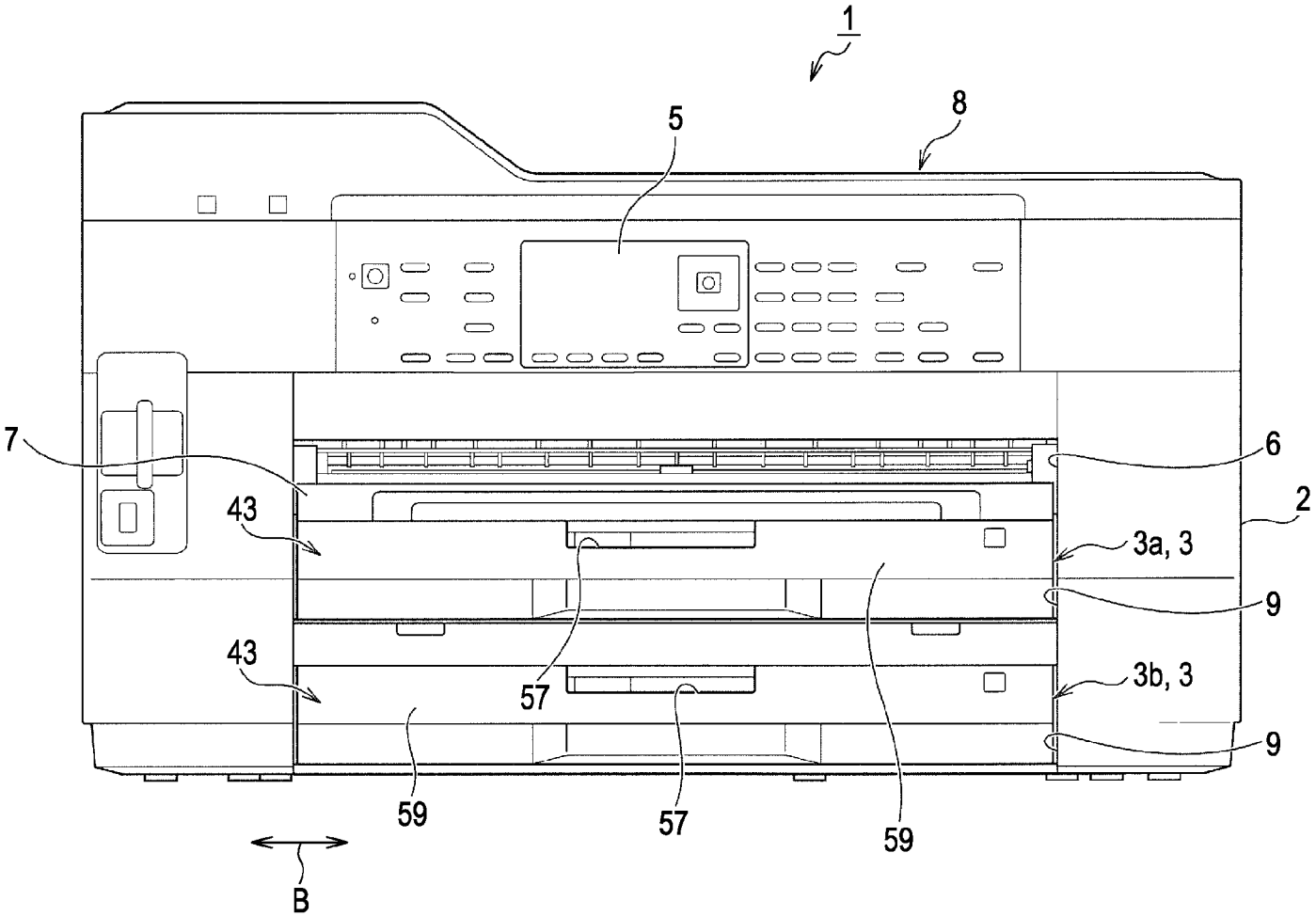
FIG. 4 is a front view illustrating the recording apparatus provided with the recording material feed cassette according to the first embodiment of the invention.

As shown in FIG. 3, a cover 52 is provided, in a removable and openable/closable state, in part of the open top surface of the first cassette portion 49 and the second cassette portion 51.

Figure 6:
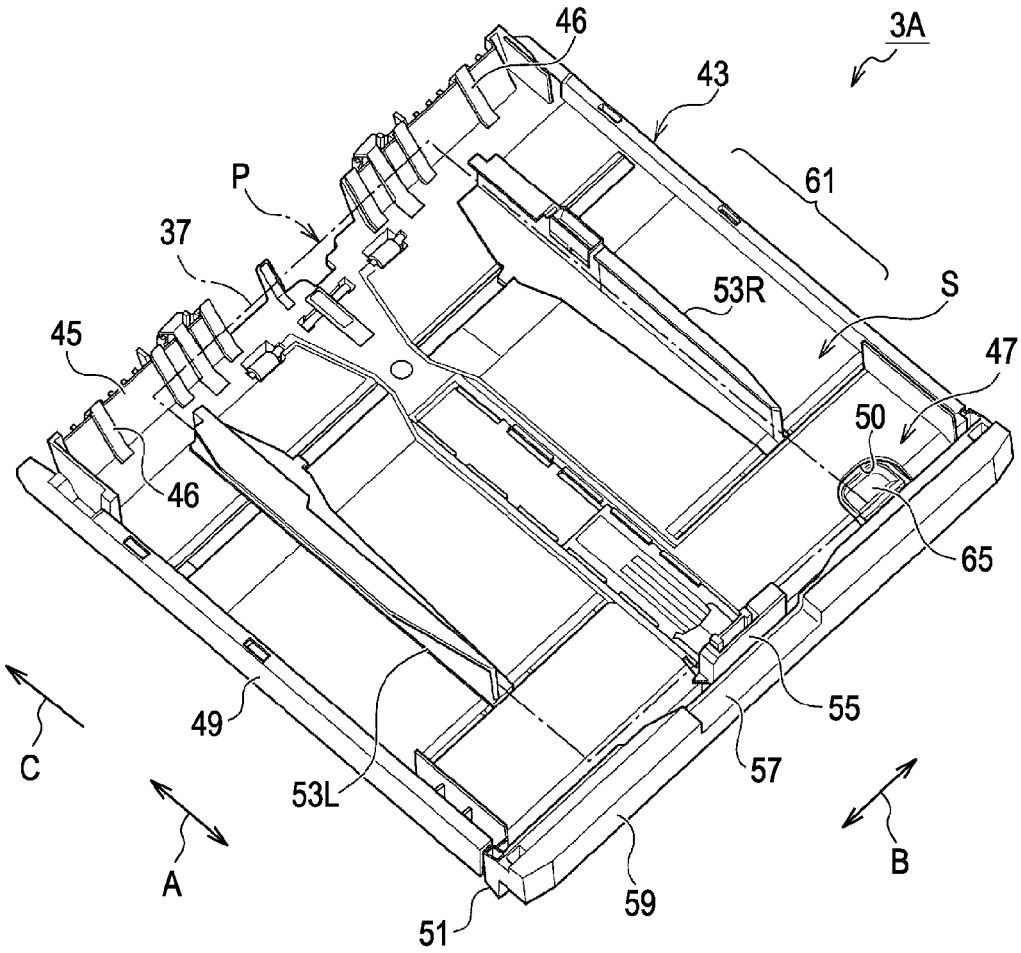
FIG. 6 is a perspective view illustrating a state in which the recording material feed cassette according to the first embodiment of the invention is retracted.

Meanwhile, as shown in FIG. 6, side edge guides 53L and 53R that can narrow and widen in the width direction B in order to position the sides of the contained paper P by making contact with the left and right side edges of the paper P are provided on the left and right of the inner bottom surface of the first cassette portion 49. Furthermore, separating sloped surfaces 46 that separate the uppermost sheet of paper P from the subsequent sheets of paper P by making contact with a leading edge 37 of the fed paper P, on a leading end wall 45 formed on the inner side, is provided on the leading end surface of the first cassette portion 49.

Figure 9:
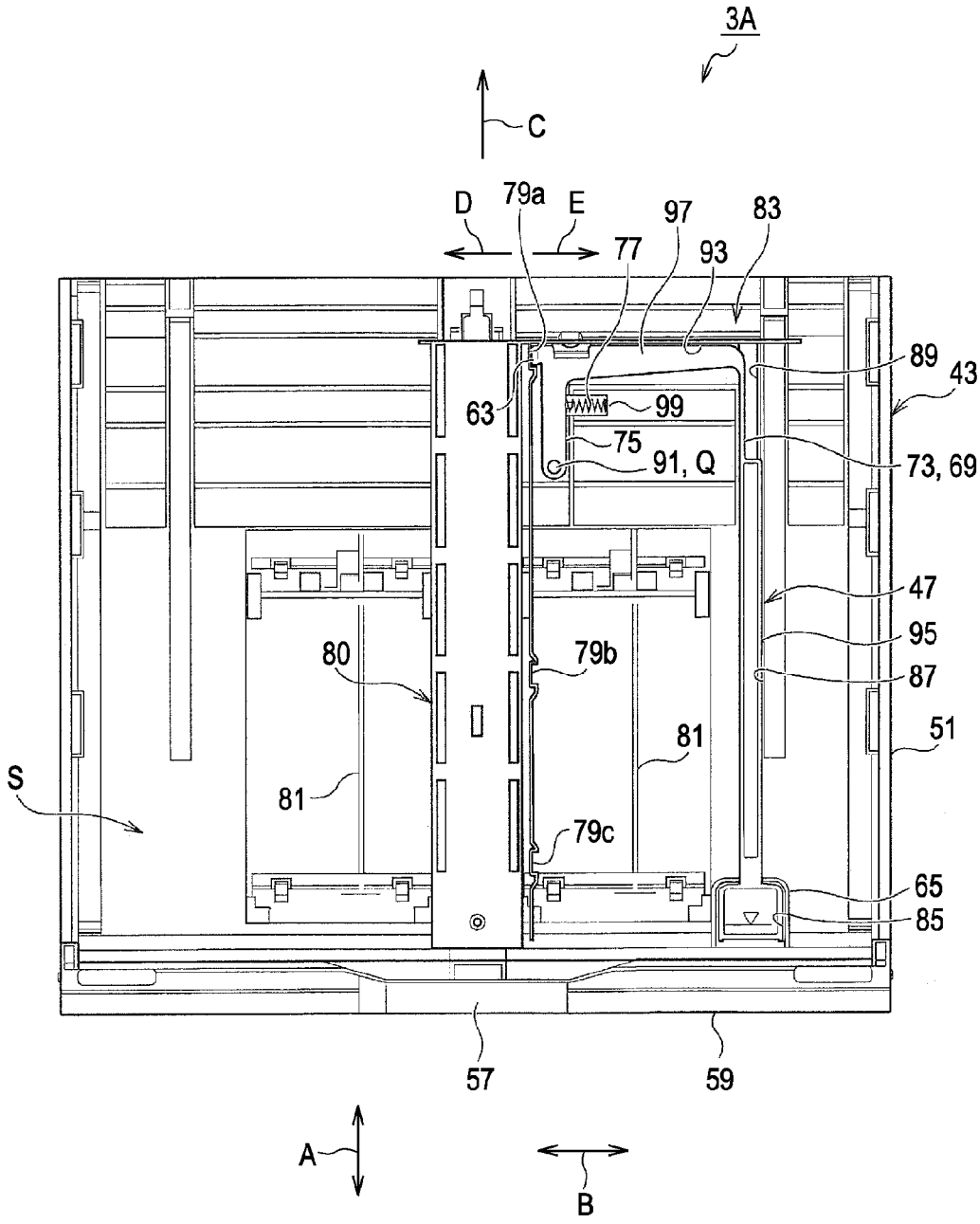
FIG. 9 is a plan view illustrating a state in which a lock portion is locked when the recording material feed cassette according to the first embodiment of the invention is retracted, where only a portion of a first cassette portion having an engagement recess is illustrated.
Figure 10:
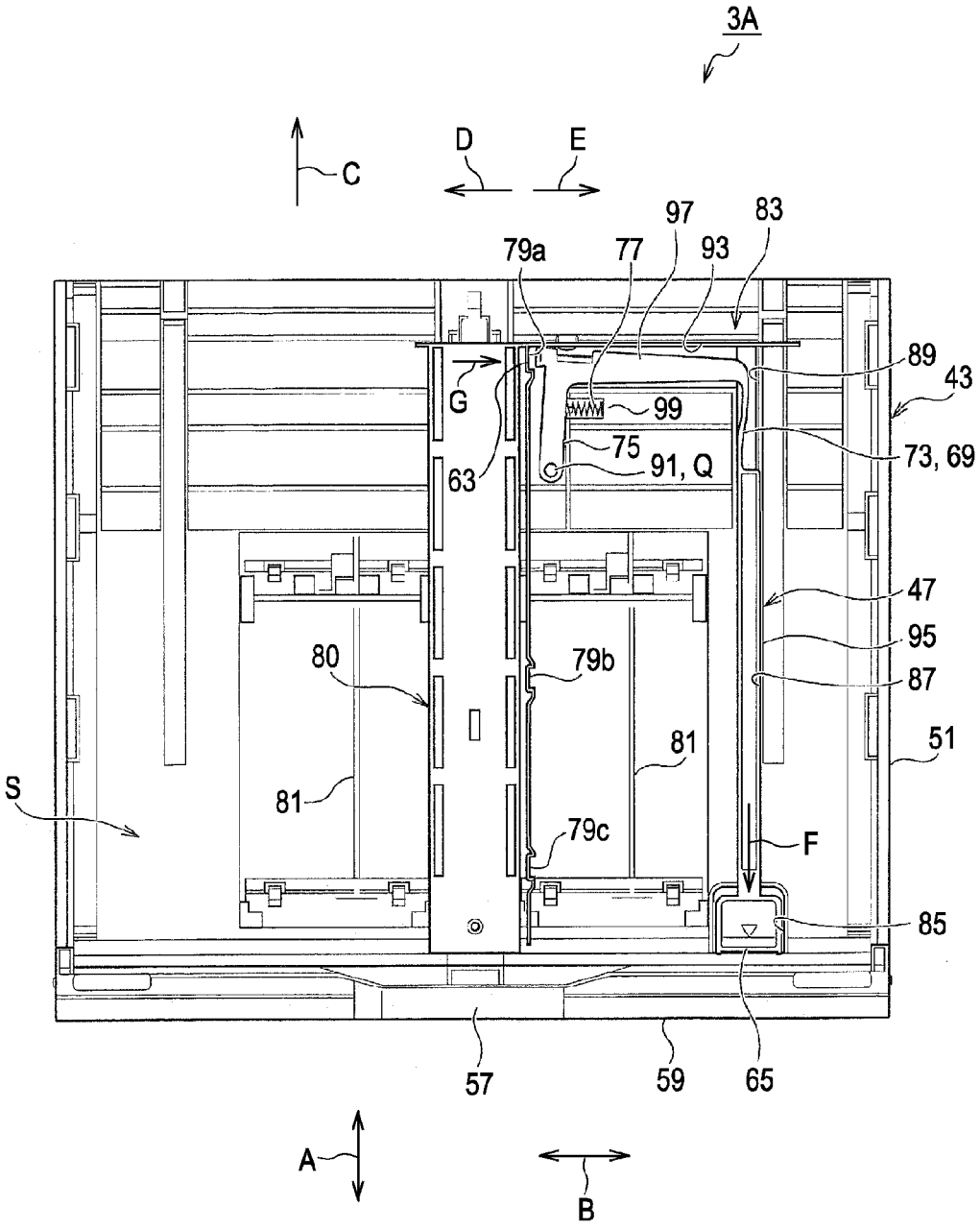
FIG. 10 is a plan view illustrating a state in which the lock portion is unlocked when the recording material feed cassette according to the first embodiment of the invention is retracted, where only the portion of the first cassette portion having an engagement recess is illustrated.
Figure 11:
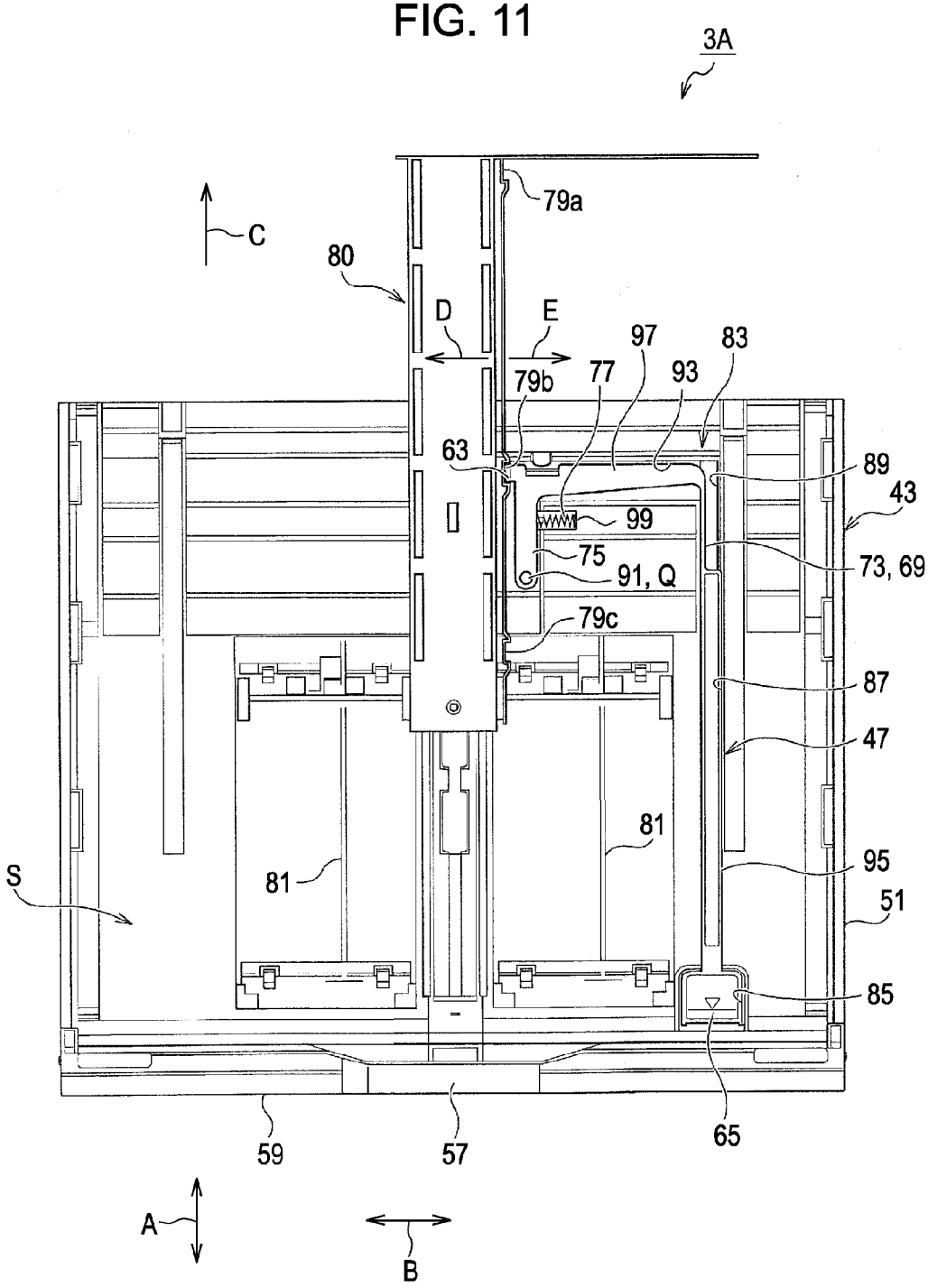
FIG. 11 is a plan view illustrating a state in which the lock portion is locked when the recording material feed cassette according to the first embodiment of the invention is extended, where only the portion of the first cassette portion having an engagement recess is illustrated.

Furthermore, the engagement structure portion 80 shown in FIGS. 9 through 11 or FIGS. 12 and 13 is provided in a base area of the first cassette portion 49. As shown in FIGS. 9 through 11, as one example of the engagement structure portion 80, three engagement recesses 79*a*, 79*b*, and 79*c*, for example, are disposed in the right side edge of the engagement structure portion 80, with their positions skewed in the extension/retraction direction A. Of these, the engagement recess 79*a*, which is located furthest toward the rear, is an engagement recess selected when retracting and storing the second cassette portion 51 in the first cassette portion 49, and as an example, is used when paper P no greater in size than A4 is set.

Meanwhile, the engagement recess 79*c*, which is located nearest toward the front, is an engagement recess selected when extending the second cassette portion 51 and pulling the second cassette portion 51 fully from the first cassette portion 49, and as an example, is used when paper P greater in size than B4 but no greater in size than super A3 is set.

Finally, the engagement recess 79*b*, which is located in the middle, is a engagement recess selected when extending the second cassette portion 51 and pulling the second cassette portion 51 from the first cassette portion 49 by one stage, and as an example, is used when paper P greater in size than A4 but no greater in size than B4 is set.

Figure 7:
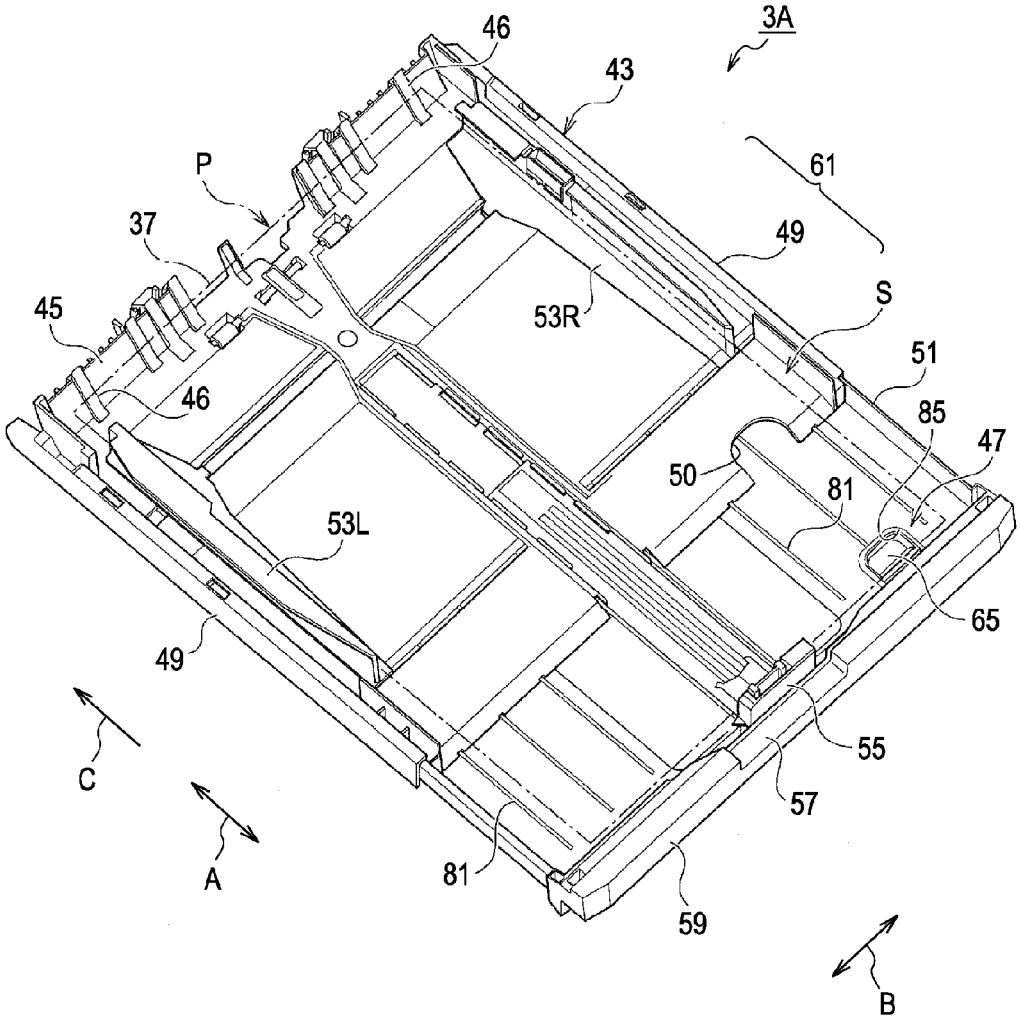
FIG. 7 is a perspective view illustrating a state in which the recording material feed cassette according to the first embodiment of the invention is extended.
Figure 8:
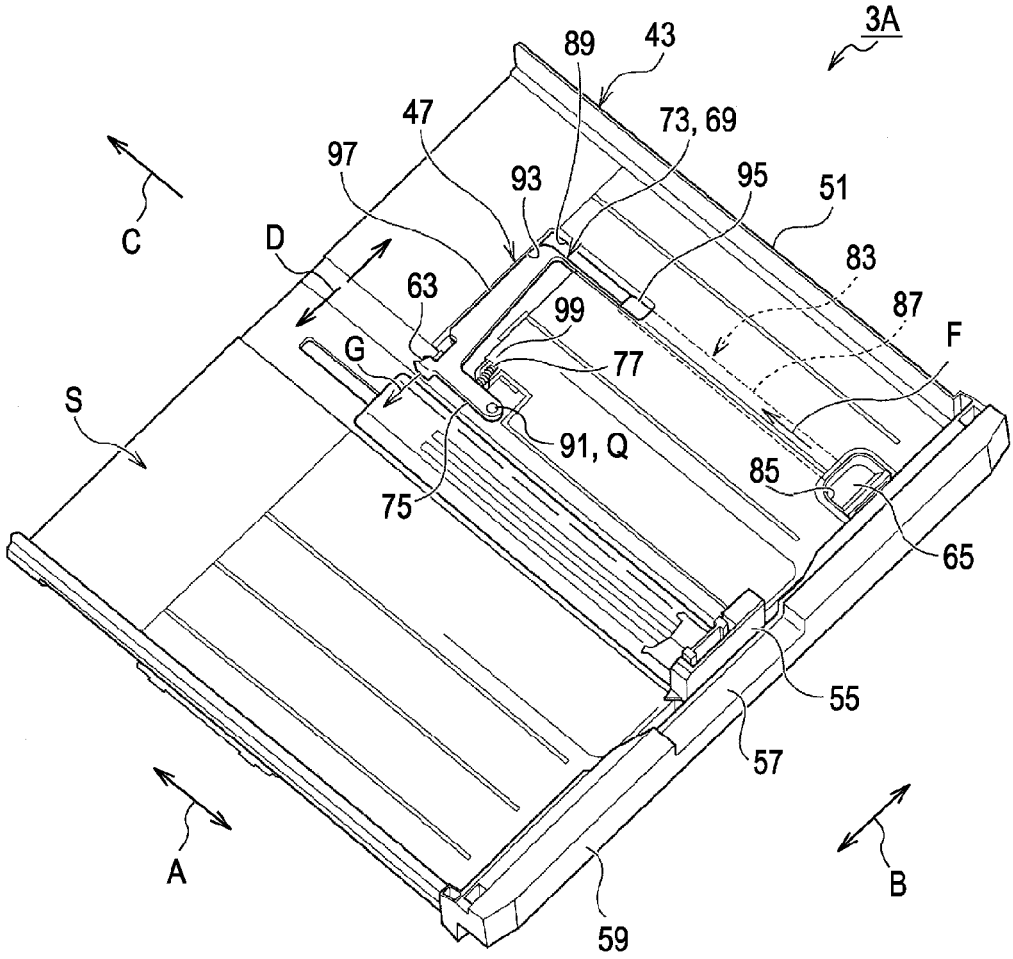
FIG. 8 is a perspective view illustrating a second cassette portion in the recording material feed cassette according to the first embodiment of the invention.

In addition, as shown in FIGS. 6 through 8, a receiving recess portion 50 that receives an operation grip portion 65 of the operation portion 95 in the locking mechanism 47 (mentioned later) is formed in a position that, for example, toward the right side in the front end edge of the first cassette portion 49 and the second cassette portion 51; the configuration is such that the operation grip portion 65 of the operation portion 95 can be operated even in the state shown in FIG. 6, where the second cassette portion 51 is retracted.

A following end edge guide 55, which positions the following end position of the contained paper P by making contact with the following edge of the paper P and that is capable of sliding in the extension/retraction direction A, is provided in the center of the bottom surface within the second cassette portion 51.

Furthermore, a panel 59 is provided in the front surface of the second cassette portion 51, and a depression 57 that serves as a handhold when extending the second cassette portion 51, removing the feed cassettes 3 that have been fitted into the cassette opening 9, and so on is provided in, for example, the center of the panel 59.

In addition, an engagement connection structure that, for example, includes engagement ribs 81 and engagement recesses (not shown) that engage with the engagement ribs 81 is provided between the bottom surface of the base portion of the first cassette portion 49 and the top surface of the base portion of the second cassette portion 51, and an engagement connection region between the engagement ribs 81 and the engagement recesses (not shown) in the engagement connection structure serves as the aforementioned engagement connection section 61.

Furthermore, a housing structure portion 83 that houses the locking mechanism 47, which will be described hereinafter, is provided in the base of the second cassette portion 51. As shown in FIGS. 9 through 11, the housing structure portion 83 is, for example, configured so as to include: a housing portion 85 that houses the operation grip portion 65; a guide portion 87 that guides the movement of the operation portion 95 in the second direction A; a deformation allowance space 89 that enables the elastic deformation portion 73 to elastically deform; and a movement space 93, housing a pivot shaft 91 that supports a pivoting base end of the pivoting arm 75 and functions as the pivot support point Q, that enables the pivoting movement of the pivoting arm 75 and the movement of the lock portion 97 in the locking direction D and a lock release direction E.

With respect to the housing structure portion 83, although a structure in which the upper surface of the guide portion 87 is covered is illustrated in FIGS. 6 through 8, this is merely a variation, and the two have functionally the same purpose.

Next, the constituent elements of the locking mechanism 47 will be described.

The operation grip portion 65 is configured of a plate-shaped member that is, as an example, quadrangular when viewed from above, and whose top surface is somewhat recessed so that the operation grip portion 65 does not protrude from the upper surface of the base of the second cassette portion 51 and so as to serve as a finger rest when operating the operation grip portion 65.

The aforementioned elastic deformation portion 73 is provided on the other end of the long operation portion 95 that extends linearly in the second direction A from the operation grip portion 65.

The elastic deformation portion 73 is formed as a shape that is less rigid than the stated operation portion 95. A structure in which the thickness of the elastic deformation portion 73 is reduced in order to configure a plate spring, a structure in which the elastic deformation portion 73 is configured of a narrow-diameter linear material, and so on can be given as specific examples of this shape.

The lock portion 97, which extends linearly toward the engagement structure portion 80 along the first direction B, is connected to the opposite end of the elastic deformation portion 73 as the end that is connected to the operation portion 95.

The lock portion 97 is configured of a wide plate-shaped member whose width gradually increases toward the free end thereof; the lock retaining portion 63, which has, for example, a rectangular plate shape, is provided on the free end of the lock portion 97, and the lock retaining portion 63 selects and engages with one of the three engagement recesses 79 formed in the engagement structure portion 80.

Meanwhile, the base end of the pivoting arm 75, which is a constituent element of the locking mechanism 47, is connected in a pivotable state to the aforementioned pivot shaft 91 provided in the vicinity of the lock retaining portion 63, and the free end of the pivoting arm 75 is in the position of the lock retaining portion 63.

Furthermore, the right side surface of the pivoting arm 75 makes contact with one of the coil ends of the aforementioned compressed coil spring 77; the compressed coil spring 77 is contained within a spring containment recess 99 formed by providing a depression in part of the upper surface of the base portion of the second cassette portion 51, and the other coil end of the compressed coil spring 77 makes contact with part of the inner wall surface of the spring containment recess 99.

Accordingly, the lock portion 97 continually experiences a biasing force in the locking direction D via the pivoting arm 75.

Next, operations of the feed cassette 3A according to this embodiment as described thus far will be described, focusing on the movement of the locking mechanism 47, (1) when the lock is released, (2) when the cassette is extended/retracted, and (3) when locking.

(1) When the Lock is Released (See FIGS. 6, 9, 10, and 12)

For example, when the retracted state of the second cassette portion 51 shown in FIG. 9 is set to a starting state, a user places his/her finger on the depressed top surface of the operation grip portion 65 that faces the bottom of the receiving recess portion 50 formed in the front edge of the first cassette portion 49, and pulls the operation grip portion 65 toward the front by a predetermined amount.

Accordingly, the operation portion 95 moves toward the front in the same manner along the second guide portion 87, and the portion of the elastic deformation portion 73 that is connected to the operation portion 95 is moved toward the front in the second direction A.

Meanwhile, in accordance with the movement of the connected portion of the operation portion 95, the elastic deformation portion 73 elastically deforms, and the portion of the elastic deformation portion 73 that is connected to the lock portion 97 moves to the right, in the first direction B shown in FIG. 9.

Due to the movement of the lock portion 97, the pivoting arm 75 pivots in the clockwise direction shown in FIG. 9 central to the pivot support point Q.

Then, due to the pivoting of the pivoting arm 75, the lock retaining portion 63 that has been engaged with the farthest engagement recess 79*a* in the engagement structure portion 80 moves in the lock release direction E, releasing the locked state held by the engagement with the engagement recess 79*a*.

Figure 13:
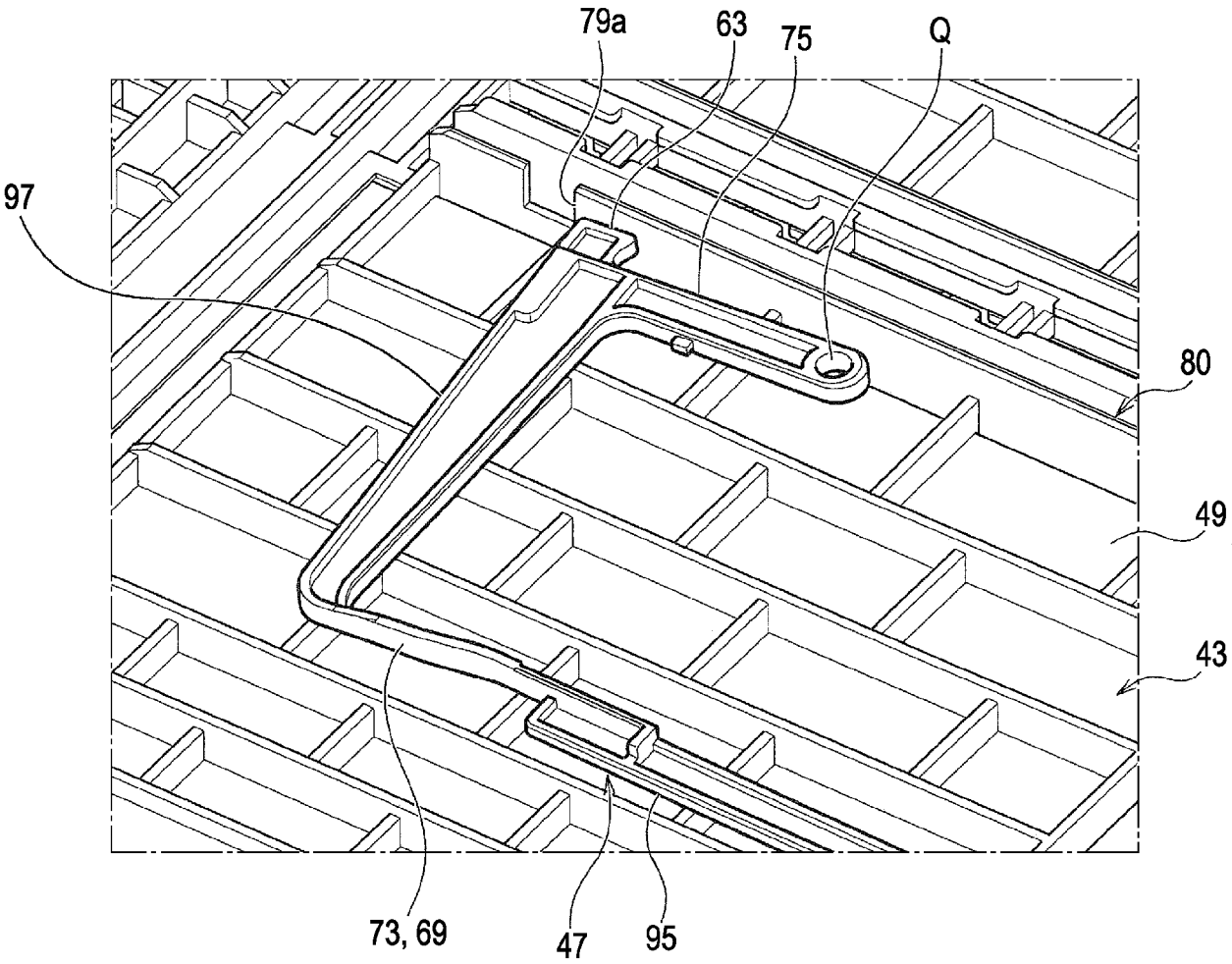
FIG. 13 is a perspective view illustrating the rear side of the first cassette in the recording material feed cassette according to the first embodiment of the invention, and illustrates, at an angle from below, a state in which the lock portion is removed from the engagement recess (which has a different shape, but the same function, as the engagement recess shown in FIGS. 9 through 11) and is slid onto a right side surface of an engagement structure portion.

(2) When the Cassette is Extended/Retracted (See FIGS. 7, 11, and 13)

Next, while the lock portion 97 is maintained still in the unlocked state, the user places his/her hand on the depression 57 formed in the panel 59 on the front surface of the second cassette portion 51 and pulls the second cassette portion 51 forward.

As a result, the lock retaining portion 63 moves outside of the engagement recess 79*a* and slides along the right side surface of the engagement structure portion 80 as far as the position in which the next engagement recess 79*b* is provided. Note that the biasing force from the compressed coil spring 77 is transmitted via the pivoting arm 75 to the lock retaining portion 63 during this movement as well, and thus the lock retaining portion 63 does not separate from the right side surface of the engagement structure portion 80, and moves while keeping the sliding state.

(3) When Locking (See FIGS. 7 and 11)

When the lock retaining portion 63 reaches the position of the next engagement recess 79*b*, the lock retaining portion 63 automatically advances into the engagement recess 79*b* due to the biasing force of the compressed coil spring 77, and thus the lock portion 97 locks in a state in which the second cassette portion 51 has been extended by one stage.

Figure 12:
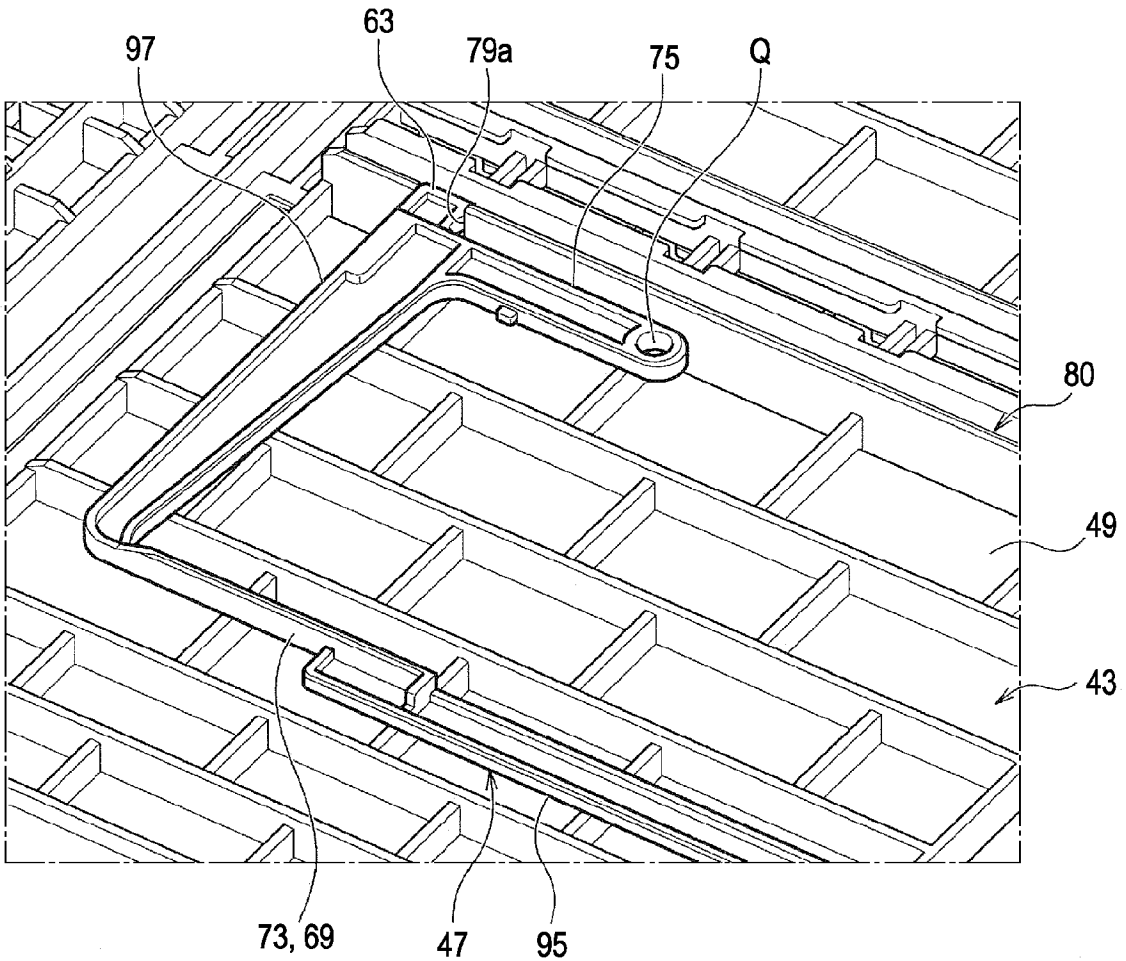
FIG. 12 is a perspective view illustrating the rear side of a first cassette in the recording material feed cassette according to the first embodiment of the invention, and illustrates, at an angle from below, a state in which the lock portion is engaged with an engagement recess (which has a different shape, but the same function, as the engagement recess shown in FIGS. 9 through 11).

Meanwhile, in the case where the second cassette portion 51 is furthermore pulled forward and extended from this state, the operations described in the aforementioned (1) through (3) may be executed again; in the case where the second cassette portion 51 is returned from this state to the original state shown in FIGS. 6, 9, and 12, the second cassette portion 51 may be pushed backward after operating the operation grip portion 65 and unlocking the lock portion 97.

According to the feed cassette 3A of this embodiment configured as described thus far, it is possible to provide an inexpensive locking mechanism 47 that has a simple structure and a low number of components. Furthermore, because the locking mechanism 47 according to this embodiment is lightweight, compact, and has superior operability, and because the rigidity of the lock portion 97 can be increased, it is easy to ensure the reliability of the lock portion 97.

Second Embodiment

Figure 14:
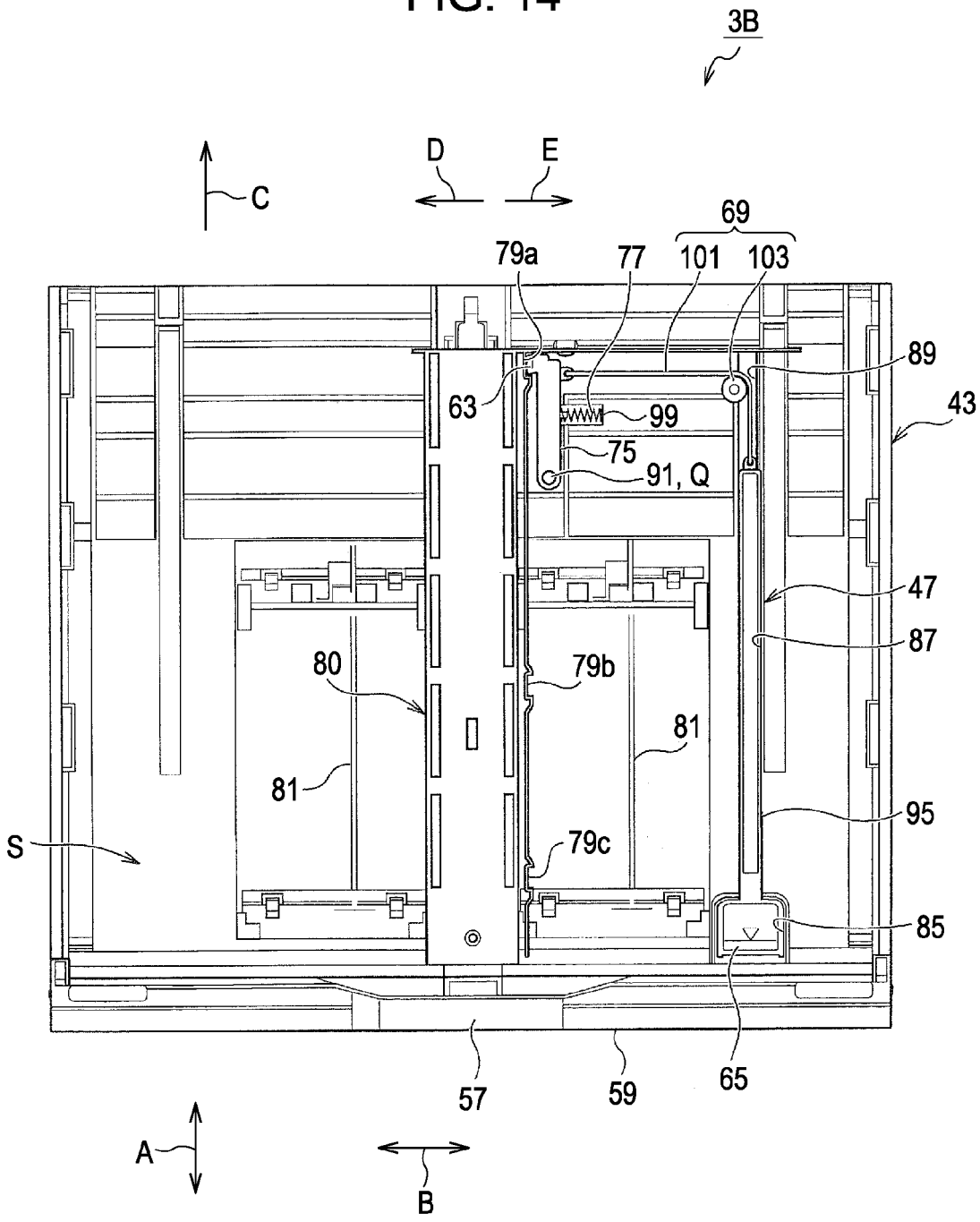
FIG. 14 is a plan view illustrating a locking mechanism when a recording material feed cassette according to a second embodiment of the invention is retracted, where only a portion of a first cassette portion having an engagement recess is illustrated.

See FIG. 14

A recording material feed cassette 3B according to the second embodiment has the same configuration as the recording material feed cassette 3A according to the first embodiment, with the exception of the configuration of the connection portion 69, which can deform.

Accordingly, the descriptions given here will focus on the configuration of the connection portion 69, which is different from that in the first embodiment.

In other words, in the recording material feed cassette 3B according to the second embodiment, the connection portion 69 includes a filament member 101 and a curved surface portion 103.

Specifically, the connection portion 69 that can deform is configured so as to include: the filament member 101, one end of which is connected to the lock portion 97 and the other end of which is connected to the operation portion 95; and a guide pulley 103 (the same reference numeral as the "curved surface portion" will be used), serving, for example, as the curved surface portion 103 that converts the extension direction of the filament member 101 from the second direction A to the first direction B.

According to the recording material feed cassette 3B of the second embodiment configured as described above, the same effects as those of the recording material feed cassette 3A according to the first embodiment can be achieved. Furthermore, as effects unique to this embodiment, it is easy for the filament member 101 to freely change shape, and it is thus possible to transmit movement force between two different directions in three dimensions, rather than only in a single plane.

Third Embodiment

Figure 15:
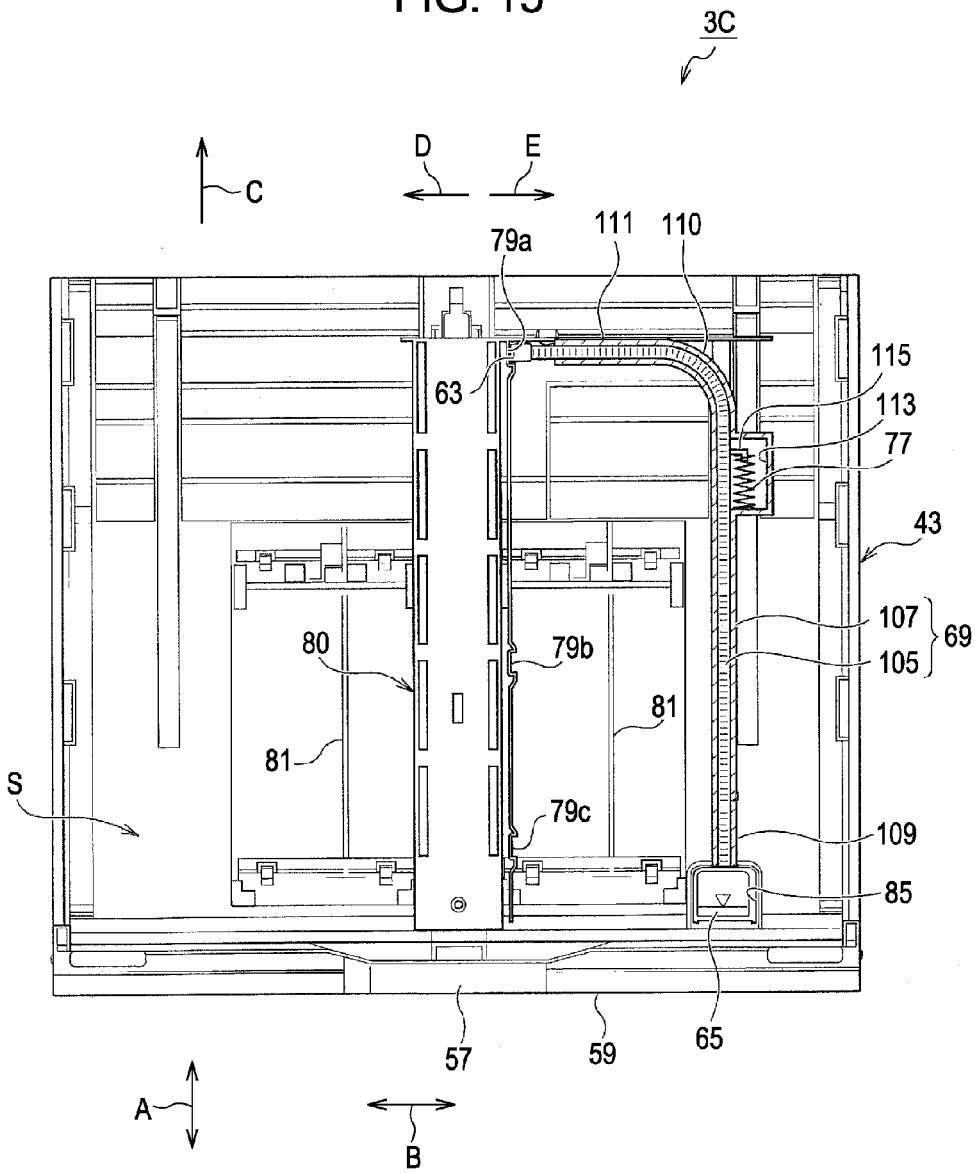
FIG. 15 is a plan cross-section illustrating a locking mechanism when a recording material feed cassette according to a third embodiment of the invention is retracted, where only a portion of a first cassette portion having an engagement recess is illustrated.

See FIG. 15

A recording material feed cassette 3C according to a third embodiment differs from the configuration of the recording material feed cassette 3A according to the first embodiment in that the configuration of the connection portion 69 that can deform has been changed and the pivoting arm 75 has been removed; aside from this, however, the basic configuration is the same as that in the first embodiment.

Accordingly, the descriptions given here will focus on the configuration of the connection portion 69, which is different from that in the first embodiment.

In other words, in the recording material feed cassette 3C according to the third embodiment, the connection portion 69 is configured of a long member 105 that can easily bend and deform, and a guidance portion 107 that guides the long member 105 in the lengthwise direction thereof from the second direction A to the first direction B is provided for the long member 105.

Specifically, the connection portion 69 is configured so as to include: the long member 105, which can easily bend and deform, and whose one end is connected to the lock retaining portion 63 of the lock portion 97 and whose other end is connected to the operation grip portion 65 of the operation portion 95; and the guidance portion 107 that guides the long member 105 in the lengthwise direction thereof from the second direction A to the first direction B.

In addition, in this embodiment, the entirety of the connection portion 69 is configured of the long member 105 that can easily bend and deform, and a pipe-shaped guide portion that includes a second straight pipe portion 109, a curved pipe portion 110, and a first straight pipe portion 111 which enclose the long member 105 is applied as the guidance portion 107.

Furthermore, the pivoting arm 75 that was provided in the first embodiment has been eliminated, and the compressed coil spring 77 that acted on the pivoting arm 75 in the first embodiment is provided, in a spring housing recess 113 provided between the second straight pipe portion 109 and the curved pipe portion 110, in a compressed state between a retaining piece 115 that protrudes from the trunk of the long member 105 and the wall surface of the spring housing recess 113 that opposes the retaining piece 115.

According to the recording material feed cassette 3C of the third embodiment configured as described above, the same effects as those of the recording material feed cassette 3A according to the first embodiment can be achieved. Furthermore, as effects unique to this embodiment, the second straight pipe portion 109 works to guide the movement of the operation portion 95 in the second direction A, and the curved pipe portion 110 works to convert the motion of the operation portion 95 into motion of the lock portion 97.

Furthermore, the first straight pipe portion 111 has a guiding action that regulates the movement trajectory of the lock portion 97 and thus corresponds to the pivoting arm 75 of the first embodiment. Further still, the long member 105 according to this embodiment can provide a movement force transmission function even when used in a pushed-in direction, in addition to the pulled-out direction achieved with the filament member 101 according to the second embodiment.

Other Embodiments

Although the recording material feed cassette 3 according to the invention and the recording apparatus 1 provided with the recording material feed cassette 3 are basically configured as described thus far, it is of course possible to change or eliminate parts of the configuration without departing from the essential spirit of the invention.

For example, in the first embodiment, rather than forming the elastic deformation portion 73 as a shape that elastically deforms with ease, the elastic deformation portion 73 can be configured as a separate constituent element from the other constituent elements of the locking mechanism 47, and originally, the elastic deformation portion 73 can be formed from an elastic member capable of elastic deformation.

In addition, it is possible to provide stoppers or the like on parts of the operation portion 95, the connection portion 69, and so on, for holding the mobile ends and regulating the movement amounts thereof. In the case where such stoppers have been provided, the compressed coil spring 77 employed in the first through third embodiments can be omitted, and thus the lock portion 97 is switched between a locked state and an unlocked state manually.

Furthermore, the recording material feed cassette 3 according to the invention is not limited to the aforementioned ink jet printer 1, and can of course be applied in another recording apparatus 1 such as a laser printer, a copier, a facsimile device, or the like.

The entire disclosure of Japanese Patent Application No: 2011-060829, filed Mar. 18, 2011 is expressly incorporated by reference herein.

What is claimed is:

1. A recording material feed cassette comprising:

a first cassette portion;

a second cassette portion that is assembled with the first cassette portion so as to be capable of extending in an extension direction and retracting in a retraction direction relative to the first cassette portion and that, along with the first cassette portion, contains a recording material; and a locking mechanism that fixes the position of the second cassette portion relative to the first cassette portion, wherein the locking mechanism is provided in a base of the second cassette portion and wherein the locking mechanism includes:

a lock portion capable of moving in a first direction that is orthogonal to the extension direction and to the retraction direction so as to take on a locked position and an unlocked position;

an operation portion that is provided in the second cassette portion and that is capable of moving in a second direction that follows the extension direction and the retraction direction; and a connection portion that connects the lock portion and the operation portion and that is capable of deforming as a result of the movement of the lock portion in the first direction, wherein the connection portion includes:

a filament member whose one end is connected to the lock portion and whose other end is connected to the operation portion; and a curved surface portion that changes the direction in which the filament member extends from the operation portion from the second direction to the first direction.

2. The recording material feed cassette according to claim 1, wherein the connection portion has an elastic deformation portion that, by elastically deforming, converts a force in the second direction inputted through the operation portion into a force in the first direction and causes the lock portion to move.

3. The recording material feed cassette according to claim 2, wherein the lock portion, the operation portion, and the connection portion are formed as an integrated unit; and the elastic deformation portion is formed as a shape that is more susceptible to elastic deformation than the portions that configure the operation portion and the lock portion.

4. The recording material feed cassette according to claim 1, wherein the operation portion is configured so that the movement of the operation portion in the second direction is guided by a guide portion.

5. The recording material feed cassette according to claim 1, wherein the lock portion has a pivoting arm that pivots central to a pivot support point, and the free end of the pivoting arm has a lock retaining portion that engages with the first cassette portion.

6. The recording material feed cassette according to claim 1, wherein the lock portion is biased in a locking direction by a biasing member.

7. The recording material feed cassette according to claim 1, wherein the connection portion is configured of a long member that can easily bend and deform; and a guiding portion that guides the long member from the second direction to the first direction is provided, and the long member is guided by the guiding portion.

8. A recording apparatus into which a removable recording material feed cassette that contains a recording material in a stacked state can be fitted, wherein the recording material feed cassette is the recording material feed cassette according to claim 1.

* * * * *